US005523831A

United States Patent [19]

Rushing

[11] Patent Number: 5,523,831

[45] Date of Patent: Jun. 4, 1996

[54] ACCURATE DYNAMIC CONTROL OF THE POTENTIAL ON THE PHOTOCONDUCTOR SURFACE USING AN UPDATABLE LOOK-UP TABLE

[75] Inventor: Allen J. Rushing, Webster, N.Y.

[73] Assignee: Eastman Kodak Company, Rochester, N.Y.

[21] Appl. No.: 214,901

[22] Filed: Mar. 17, 1994

[51] Int. Cl.[6] ..... G03G 21/00

[52] U.S. Cl. ..... 355/208; 355/219

[58] Field of Search ..... 355/208, 214, 355/219, 221, 225

[56] References Cited

U.S. PATENT DOCUMENTS

| | | | |
|---|---|---|---|
| 4,348,099 | 9/1982 | Fantozzi | 355/208 |
| 4,355,885 | 10/1982 | Nagashima | 355/208 |
| 4,417,804 | 11/1983 | Werner, Jr. | 355/221 |
| 4,484,811 | 11/1984 | Nakahata et al. | 355/208 |
| 4,512,652 | 4/1985 | Buck et al. | 355/219 |
| 4,618,249 | 10/1986 | Minor | 355/221 X |
| 4,695,723 | 9/1987 | Minor | 250/325 |
| 4,697,920 | 10/1987 | Palm et al. | 355/327 |
| 4,708,459 | 11/1987 | Cowan et al. | 355/208 X |
| 4,796,064 | 1/1989 | Torrey | 355/208 |
| 4,941,004 | 7/1990 | Pham et al. | 346/160 |
| 5,103,260 | 4/1992 | Tompkins et al. | 355/208 |
| 5,170,210 | 12/1992 | Saruwatari | 355/208 |
| 5,173,734 | 12/1992 | Shimizu et al. | 355/208 |
| 5,262,825 | 11/1993 | Nordeen et al. | 355/208 |
| 5,305,057 | 4/1994 | Hattori et al. | 355/214 X |
| 5,359,393 | 10/1994 | Folkins | 355/208 |

*Primary Examiner*—Robert Beatty
*Attorney, Agent, or Firm*—Norman Rushefsky

[57] ABSTRACT

The voltages, $V_0$, on a photoconductor surface are measured over a wide range of grid voltages, the results of which are stored in a look-up table $V_{grid}$ vs. $V_0$. The updated $V_{grid}/V_0$ look-up table permits automatic and accurate adjustment of the primary charging step in the electrographic cycle. This method accommodates any number of desired $V_0$ levels over a wide range of voltage. The present use establishes the relationship without going through a lengthy iterative procedure inherent in using feedback adjustment loops. The calibrated look-up table is updated as often as is required to compensate for such things as aging, wear, and environmental changes, to name a few. Calibration is repeated and the entire look-up table is updated after certain intervals of time or usage, or whenever drift is detected at even a single point of the $V_{grid}$ to $V_0$ relationship. This compensates for the variability of corona charging over time as well as over a range of $V_0$'s.

13 Claims, 5 Drawing Sheets

400
POWER UP
YES
NO
402
BIG ENVIR. CHANGE
YES
NO
406
EXCESSIVE ERROR
YES
NO
408
LONG TIME SINCE LAST UPDATE
YES
NO
410
FINISH CURRENT JOB
ENTER CALIBRATION CYCLE FOR LUT
A
B

ACCURATE DYNAMIC CONTROL OF THE POTENTIAL ON THE PHOTOCONDUCTOR SURFACE USING AN UPDATABLE LOOK-UP TABLE

TECHNICAL FIELD OF THE INVENTION

The present invention relates to image-formation apparatus and, in particular, to the control of the surface potential of an image-beating member.

BACKGROUND OF THE INVENTION

In the process of electrophotographic printing, the photoconductive members are uniformly charged and exposed to a light image of an original document. Exposure of the photoconductive member records an electrostatic latent image corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to form a toner powder image on the photoconductive member which corresponds to the informational areas contained within the original document. This toner powder image is substantially transferred to a copy sheet and permanently affixed thereto in image configuration.

Electrophotographic copiers and printers utilize distinct voltage levels on the photoconductor surface $V_0$ levels for each color separation, requiring dynamic frame-to-frame changes in $V_0$. Even mono-color machines may have different operating modes, e.g., text and photo, requiring substantial frame-to-frame changes in $V_0$. Furthermore, the desired $V_0$ levels may depend on the measured relative humidity (RH), to compensate for the developer sensitivity to RH and may change over time as the photoconductor voltage changes.

For grid-control corona chargers, the grid voltage, $V_{grid}$, is set to obtain the desired potential, $V_0$, on the photoconductor surface. Unfortunately, the relationship between grid voltage and $V_0$ is affected by the variable emission of the corona wires and the variable charge acceptance of the photoconductor. Other factors such as aging, wear, contamination, corrosion, and variable environmental conditions can all add variability to the nominal $V_{grid}$-to-$V_0$ relationship.

In the prior art, a fixed relationship or calibration is assumed between $V_{grid}$ and $V_0$. Accuracy and repeatability of $V_0$ are degraded from the ideal, due to the variability described above, leading to inconsistent and unsatisfactory image quality.

Previous approaches deal with charging variability having utilized feedback control with an on-line electrometer. $V_0$ is measured, and $V_{grid}$ is adjusted on a continuous or sampled basis to maintain the desired $V_0$.

U.S. Pat. No. 4,697,920 in the name of Palm et al discloses a print quality monitoring system with an electrometer to monitor test patch areas on the photoconductor. Some patches are charged and unexposed; others are charged and exposed through color separation filters to images of cyan, magenta, and yellow reference bars. The primary corona charge input voltage is adjusted until the electrometer measurements are within acceptable ranges. The charger adjustment depends on the error from the desired photoconductor voltage level according to a look-up table (LUT). This look-up table is not updated, and yields adjustments rather than absolute charger settings, to be applied to the charger in an iterative procedure.

U.S. Pat. No. 4,796,064 in the name of Torrey discloses charger adjustment with both a "predictive" and an "adaptive" component. The predictive component is based on the rest/run history of the photoconductor. The adaptive component is accomplished by an iterative measure-and-adjust cycle, until the one desired photoconductor voltage is obtained. It is asserted that the same adjustment applies also when there is a different desired photoconductive voltage, but for the most accurate adjustment, the iterative process would have to be repeated.

U.S. Pat. No. 4,512,652 in the name of Buck et al adjusts the charging current in a predetermined open-loop manner as a function of rest time between successive copy cycles to attain a specific target surface voltage. One drawback with this arrangement is that there is no provision for a range of target voltages or updating the adjustment function based on surface voltage measurements fed back.

U.S. Pat. No. 4,348,099 in the name of Fantozzi is directed to a multi-loop feedback control system for a reproduction machine. One of the feedback loops comprises an automatically adjusted corona charging device with a feedback control loop to regulate the dark development potential to a desired value despite the effects of fatigue and age. Once again, there is no provision for switching immediately through a range of target surface voltages. Any changes in the target voltage would require time for the close-loop to converge to the new target, owing to the delay between the time the adjustment is applied and the time the resultant surface potential can be measured.

U.S. Pat. No. 4,355,885 in the name of Nagashima relates to a feedback control loop around the corona charging unit, wherein the charger adjustments are reduced in successive iterations of the measure-calculate-adjust procedure, to improve the speed and accuracy of the conversions of the desired surface voltage. Again, there is no provision for switching immediately through a range of target surface voltages.

U.S. Pat. No. 4,484,811 in the name of Nakahata discloses methods for use in inspection and service to check the desired surface voltages attained when an exposure device is adjusted through a range. There is no provision for the updatable look-up table to be used in the normal imaging mode, relating the corona adjustment to a range of target dark surface voltages.

Thus, it can be seen that it would be inconvenient and time consuming to use feedback control to converge the desired $V_0$ every time the desired $V_0$ changes. This is owing to the displacement or transport delay between the corona charger and the measuring electrometer, which determines the minimum time to accomplish a single iteration in the feedback adjustment procedure. Instead, a calibration cycle is run from time to time to determine the $V_{grid}$ to $V_0$ relationship over a wide range of voltage. The resultant calibration table is used to immediately set the appropriate $V_{grid}$ whenever the desired $V_0$ is changed, interpolating from the table entries, if necessary. There is no need for a time consuming feedback control cycle to converge to the desired $V_0$ level each time the desired $V_0$ changes.

SUMMARY OF THE INVENTION

The present invention establishes, by $V_0$ measurement, the $V_{grid}$ vs. $V_0$ relationship over a wide range, and stores the results in a look-up table (LUT). Subsequently, one uses the established relationship without going through a lengthy iterative procedure inherent in the feedback adjustment loop. The calibrated LUT is updated as often as is required to compensate for such things as aging, wear, environmental, etc.

The updated $V_{grid}/V_0$ LUT permits automatic and accurate adjustment of the primary charging step in the electrographic cycle. This method accommodates any number of desired $V_0$ levels over a wide range of voltage. There is no need to interrupt imaging frames when $V_0$ needs to be changed, to wait for a feedback adjustment. The calibration is repeated and the entire look-up table is updated after certain intervals of time or usage, or whenever drift is detected at even a single point of the $V_{grid}$ to $V_0$ relationship. The method thus compensates for the variability of corona charging over time as well as over a range of $V_0$'s.

The present invention provides an image-forming apparatus provided with a surface potential measuring device for measuring the voltage on the surface of the photoconductive surface of the image-bearing member, said apparatus comprising a primary corona charger for applying a voltage to the image-bearing member and a variable power supply for varying the voltage on said corona charger. An electrometer measures the voltage on the photoconductive surface with means for accessing a look-up table containing a charger voltage that corresponds to a desired voltage on the surface of the image-bearing member. The variable power supply is then adjusted to obtain the charger voltage that results in the desired voltage on the photoconductive surface according to the look-up table.

BRIEF DESCRIPTION OF THE DRAWINGS

Other aspects of the present invention will become apparent as the following description proceeds and upon reference to the drawings in which.

DETAILED DESCRIPTION OF THE PREFERRED EMBODIMENT

Because electrophotographic reproduction apparatus are well known, the present description will be directed, in particular, to elements forming part of, or cooperating more directly with, the present invention. Apparatus not specifically shown are described herein are selectable from those known in the prior art.

Figure 1:
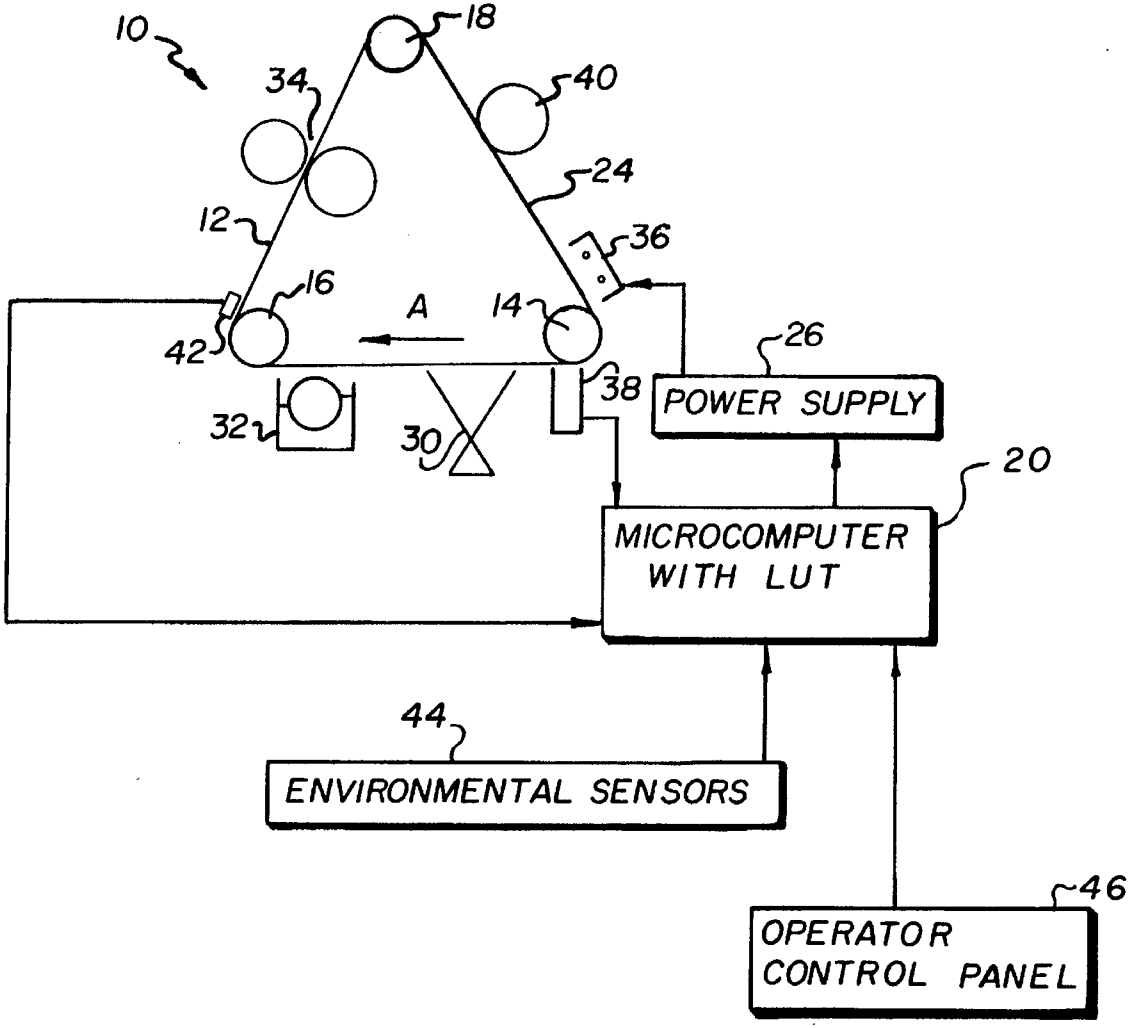
FIG. 1 is a schematic elevational view showing an electrophotographic printing machine incorporating the features of the present invention.

With reference now to FIG. 1, in an electrophotographic reproduction apparatus 10 includes a recording medium such as a photoconductive web 12 or other photosensitive medium that is trained about three transport rollers 14, 16 and 18, thereby forming an endless or continuous web. Roller 14 is coupled to a drive motor (not shown) in a conventional manner which, in turn, is connected to a source of potential that when a switch (not shown) is closed by a logic and control unit such as a microcomputer 20, the roller 14 is driven by the motor and moves the web 12 in a clockwise direction as indicated by arrow A. This movement causes successive image areas of the web 12 to sequentially pass a series of electrophotographic work stations of the reproduction apparatus.

For the purpose of the instant exposure, several work stations are shown along the web's path. These stations will be briefly described.

First, a charging station 36 is provided at which the photoconductive surface 24 of the web 12 is sensitized by applying to such surface a uniform electrostatic primary charge of a predetermined voltage. The output of the charger may be controlled by a grid connected to a power supply 26. The supply is, in turn, controlled by the microcomputer 20 to adjust the voltage level $V_0$ on the surface 24 of the photoconductor 12.

At an exposure station 30, an electrostatic image is formed by either optically projecting an image of a document onto the photosensitive photoconductive surface or by modulating the primary charge on an image area of the surface 24 with a selective energization of point-like radiation sources in accordance with the signals provided by a source of data (not shown).

A development station 32 includes developer which may consist of iron carrier particles and electroscopic toner particles with an electrostatic charge opposite to that of the latent electrostatic image. A developer is brushed over the photoconductive surface 24 of the web 12 and toner particles adhere to the latent electrostatic image to form a visible toner particle, transferable image. The development station may be of the magnetic brush type with one or two rollers. Alternatively, the toner particles may have a charge of the same polarity as that of the latent electrostatic image and develop the image in accordance with known reversal development techniques.

The apparatus 10 also includes a transfer station 34 at which point the toner image on the web 12 is transferred to a copy sheet (not shown) and a cleaning station 40, at which the photoconductive surface 24 of the web 12 is cleaned of any residual toner particles remaining after the toner images have been transferred. After the transfer of the unfixed toner images to a copy sheet, such sheet is transported to a heated pressure roller fuser (not shown) where the image is fixed to the copy sheet.

The microcomputer 20 controls the programmable grid power supply 26, which is connected to the primary charger 36. The charge acceptance ($V_0$) of the moving photoconductor belt 12 is monitored by an electrometer 38 and a signal representing the charge on the photoconductor 12 is sent to the microcomputer 20. Photoconductor motion sensors 42 provide synchronization and timing signals to the microcomputer 20 including image frame count signals. A portion of the microcomputer memory is designated for the updatable LUT. Environmental sensors 44 may include sensors for temperature, relative humidity (RH), air pressure and other ambient conditions that affect the corona charging process. The operator control panel 46 may include a clock so that the passage of a long time can trigger an update of the $V_{grid}$ vs. $V_0$ LUT.

In an electrical only (non-toning) charge-erase mode of operation, $V_{grid}$ is at a predetermined sequence of values spanning the range of charger operation under all conditions for each of these values, the corresponding $V_0$ is measured by an on-line electrometer 38 (FIG. 1) and the corresponding $V_{grid}/V_0$ pairs are saved in memory to form a look-up table (LUT) within the microcomputer 20.

Figure 2:
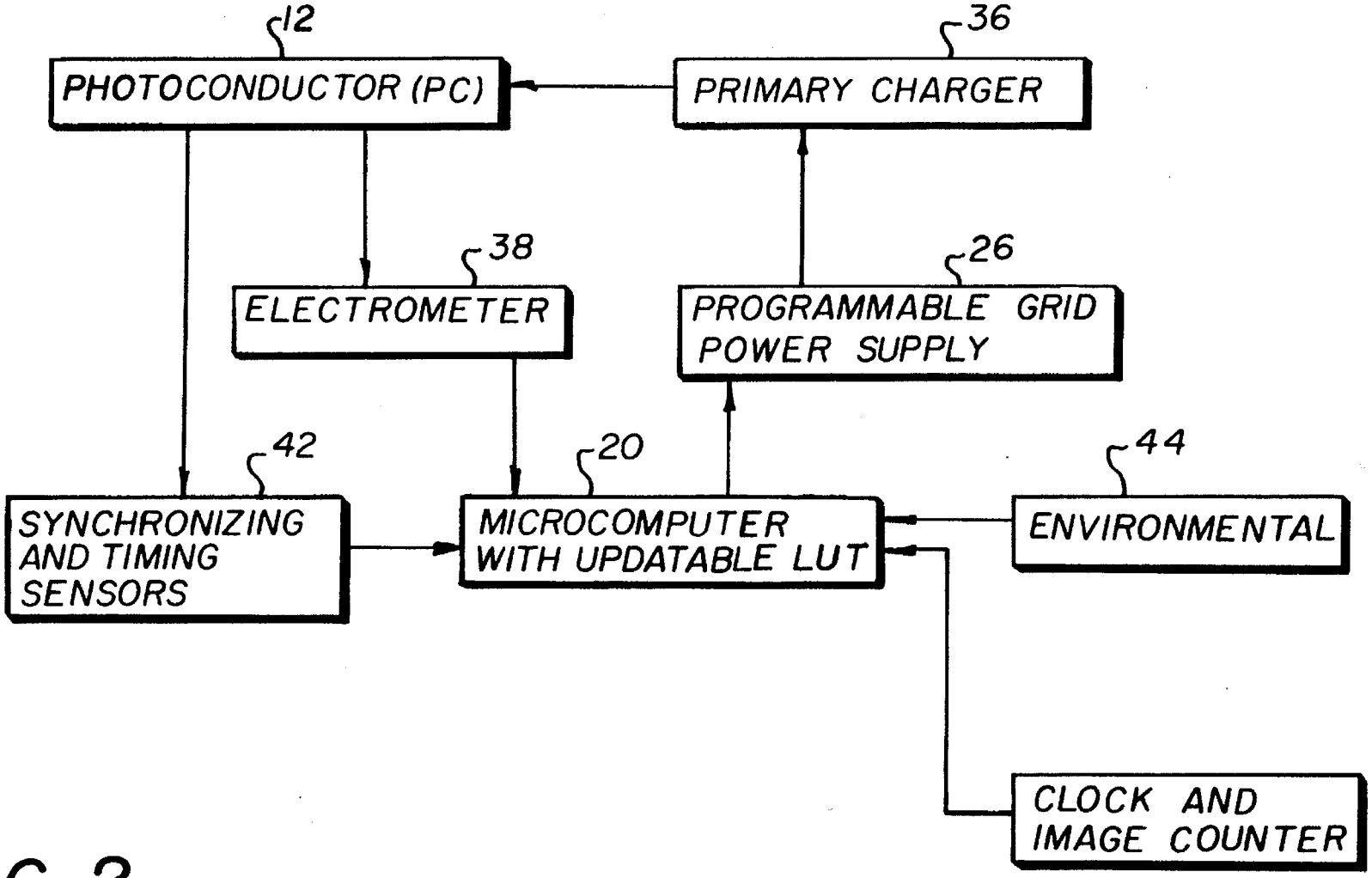
FIG. 2 is a functional block diagram illustrating the connection and function of functional elements associated with the primary charging system for the present invention.

In the occasional calibration cycle, distinct from the normal imaging cycle, the LUT is updated. This cycle is repeated whenever it is determined that the LUT needs to be updated. FIG. 2 shows the signal flow between the functional element of the calibration cycle. In FIG. 2, LUT is shown as part of the memory in the microcomputer 20 to show that the microcomputer loads the LUT with $V_{grid}/V_0$ pairs after every update. Subsequently, in the normal imaging cycle, the microcomputer references the LUT with the desired $V_0$ and the LUT returns the corresponding $V_{grid}$ value.

Figure 3:
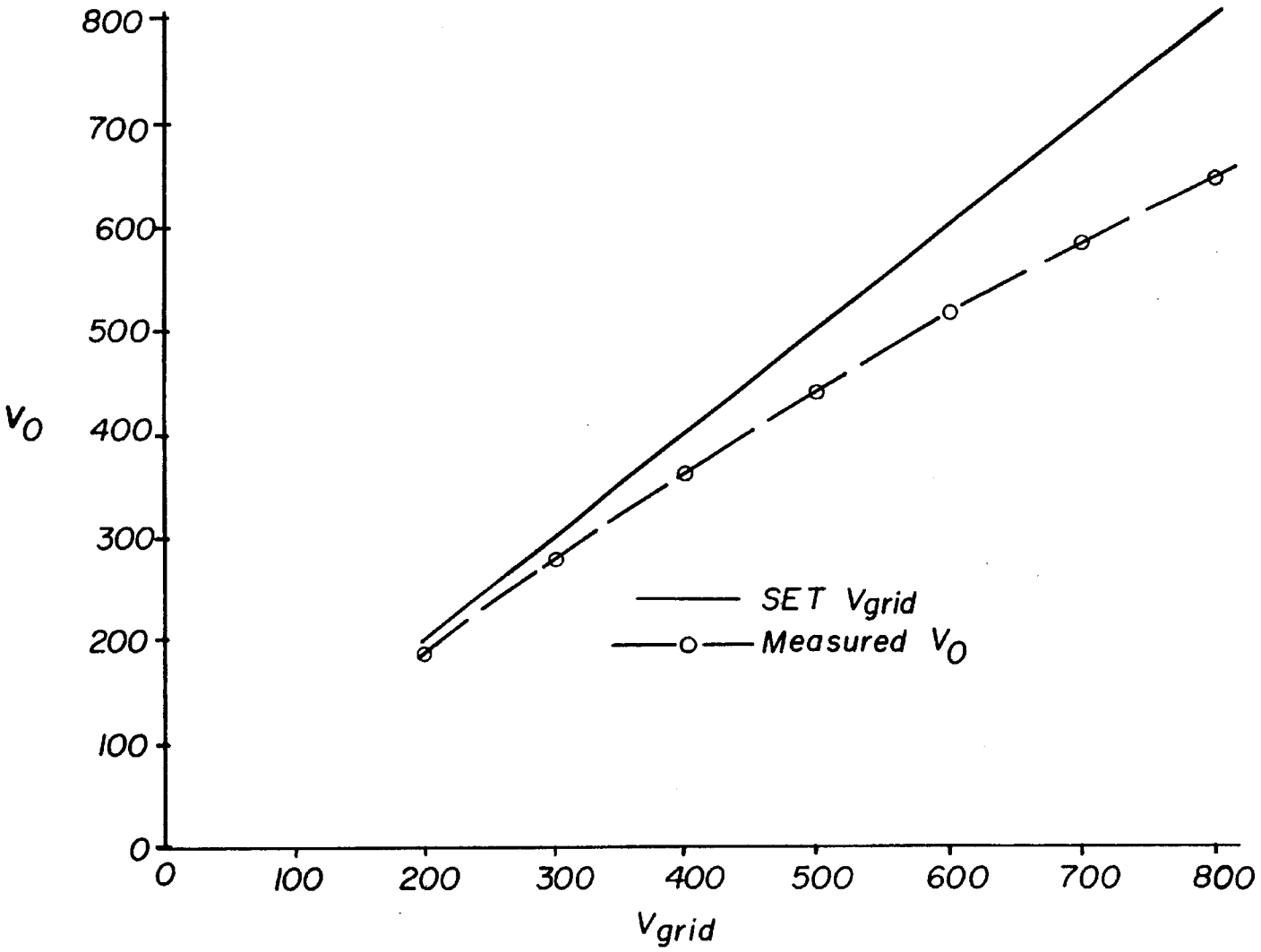
FIG. 3 is a graph illustrating the values within a look-up table for a plot of $V_{grid}$ vs. $V_0$ pairs.

FIG. 3 shows a typical $V_{grid}$ vs. $V_0$ relationship graphically. In the graph, a 45/degree line is also shown for a reference. The following table is a typical example of values that may be found in a LUT and used to run a $V_{grid}$ series and obtain $V_0$ as a function of $V_{grid}$ $V_0 = f(V_{grid})$:

TABLE I

| Run $V_{grid}$ Series. Get $V_0 = f(V_{grid})$ and Save as a LUT | | |
|---|---|---|
| Test No. | Measured $V_0$ $V_0$ meas. | Set $V_{grid}$ $V_g$ set |
| 1 | 186 | 200 |
| 2 | 278 | 300 |
| 3 | 362 | 400 |
| 4 | 440 | 500 |
| 5 | 515 | 600 |
| 6 | 580 | 700 |
| 7 | 640 | 800 |

Figure 4A:
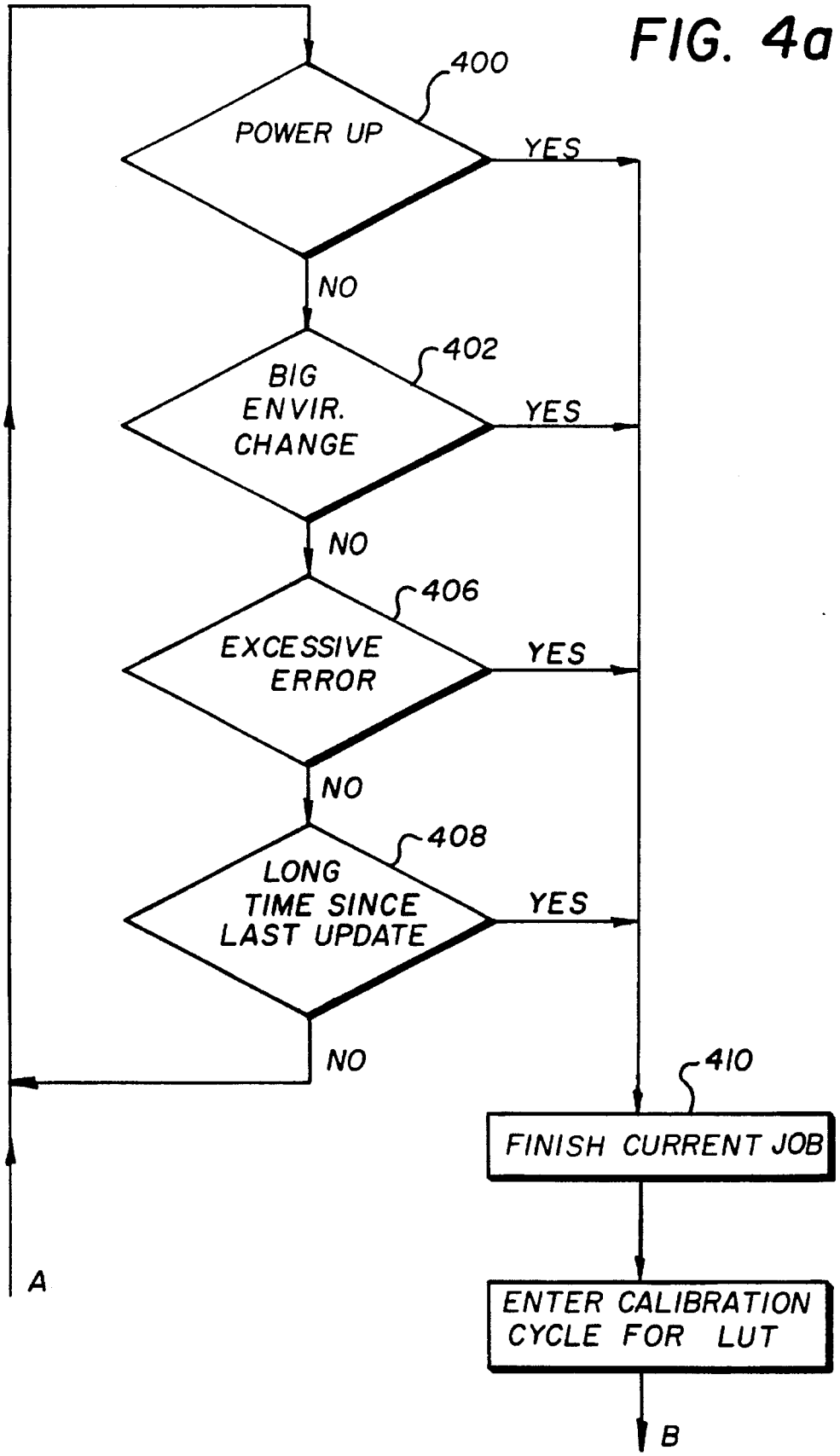
FIGS. 4A and 4B are the flow chart illustrating the calibration cycle used to update the LUT and the flow chart for the calibration cycle for the LUT, respectively.

The number of pairs of values in the LUT involves a tradeoff between (a) the accuracy required and (b) the time and memory required to update and store information in the LUT. The example LUT in Table I has seven $V_0/V_{grid}$ pairs. Any of the following conditions may trigger running the calibration cycle and updating the LUT: (a) an initial power-on; (b) big changes in temperature; relative humidity, air pressure, or other environmental conditions affecting the $V_{grid}/V_0$ relationship; (c) error between measured and intended $V_0$ beyond a predetermined threshold; (d) passage of a predetermined time interval or number of images, during which a substantial change in the $V_0/V_{grid}$ relationship might be expected, owing to photoconductor wear and fatigue or corona wire fouling, for example. A logic flow chart for triggering the calibration or update cycle is shown in FIG. 4A. The sequence for the calibration cycle itself is shown in FIG. 4B.

FIG. 4A is a logic flow chart that illustrates factors that may be used to trigger a calibration or update cycle for the LUT. Step 400 illustrates how a power up of the equipment would initiate a calibration cycle. Step 402 shows how selected environmental changes such as a change in relative humidity may be used to initiate a calibration cycle. Excessive error in $V_0$ in step 406 would also result in an update of the LUT via a calibration cycle. The actual period of time that has passed since the last calibration cycle can be the basis for a new calibration cycle, as shown in step 408. Of course, the actual time period can be determined empirically.

Figure 4B:
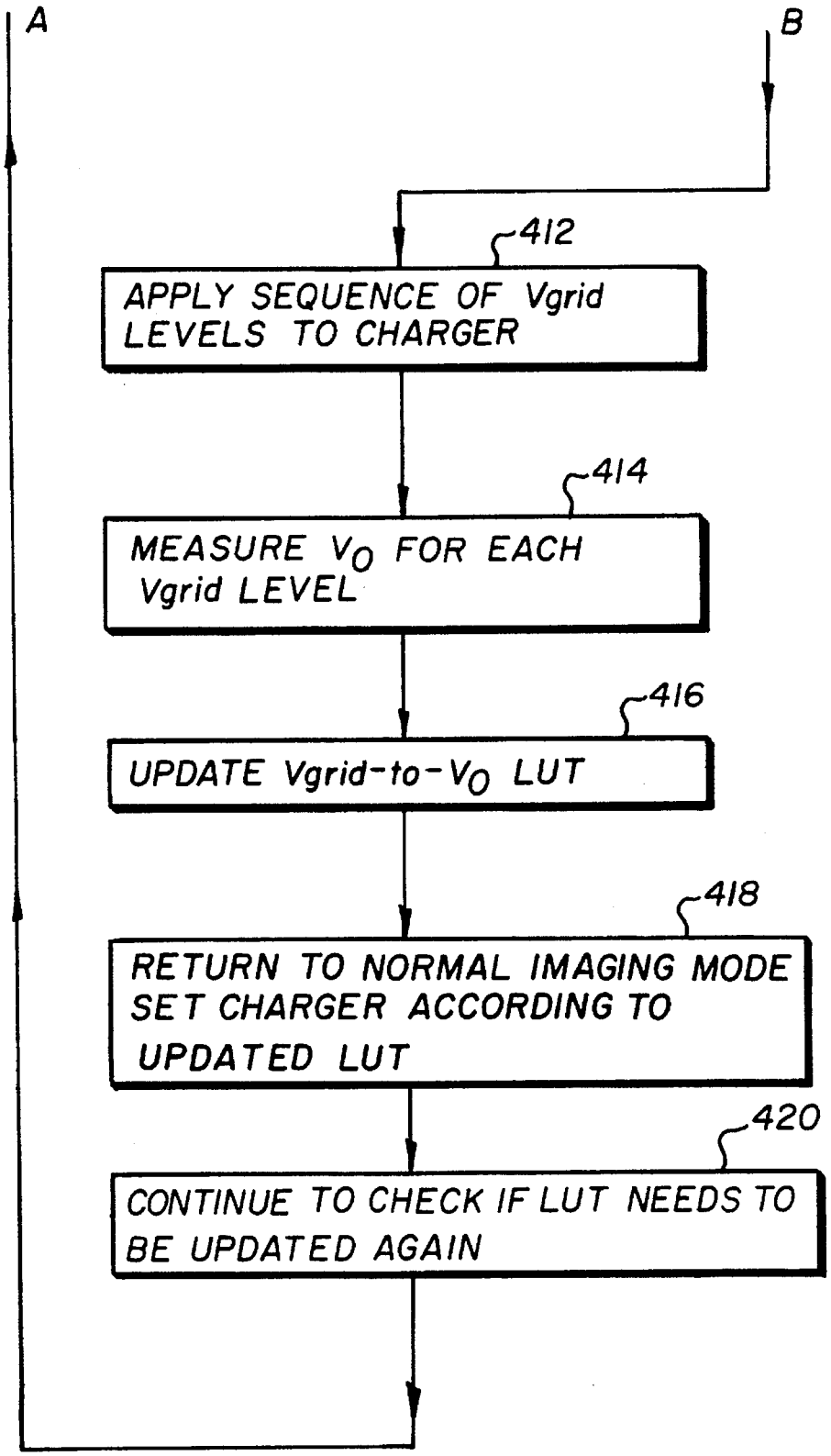

FIG. 4*b* illustrates a flow chart for the actual calibration cycle for the look-up table. In step 410, shown in FIG. 4*a*, the current job that the machine is working on must be completed before entering the calibration cycle in step 410. In the calibration cycle, a sequence of $V_{grid}$ levels are applied to the charger in accordance with instructions in step 412. Step 414 requires that for each $V_0$ applied in step 412, a corresponding $V_{grid}$ is measured. In step 416, the information obtained from steps 412 and 414 are used to update $V_{grid}$-to-$V_0$ table in LUT. In step 418, the machine is returned to normal operation in the imaging mode and the charger is set the values according to the updated LUT. Lastly, in step 420, the machine goes back to checking to see if the LUT needs to be updated as a result of any changes in the parameters of FIG. 4*a*.

Thus, it can be seen that the updated $V_{grid}/V_0$ LUT permits automatic and accurate adjustment of the primary charging step in the electrographic cycle. This method accommodates any number of desired $V_0$ levels over a wide range of voltage. There is no need to interrupt image frames when $V_0$ needs to be changed, or to wait for a feedback adjustment. The calibration is repeated and the entire LUT is updated after certain intervals of time or usage or whenever drift is detected in even a single point of the $V_{grid}$ to $V_0$ relationship. This method and apparatus thus compensate for the variability of corona charging over time, as well as over a range of $V_0$'s.

The invention has been described in detail with particular reference to preferred embodiments thereof, but it will be understood that variations and modifications can be effected within the spirit and scope of the invention.

I claim:

1. A corona charging apparatus for providing a charge on a surface of an image-forming member, said apparatus, comprising:

a primary corona charger for applying a voltage to the surface;

a variable power supply for varying the voltage on said primary corona charger;

an electrometer for measuring the voltage on the photoconductive surface;

means for accessing a look-up table containing a charger voltage that corresponds to a desired voltage on the surface of the image-forming member;

means for adjusting the variable power supply to obtain a voltage on the primary corona charger that will result in the desired corresponding voltage on the surface according to the look-up table; and means for providing a calibration cycle to update the look-up table when the voltage on the surface differs by a predetermined amount from the predicted voltage supplied by the look-up table.

2. An apparatus as set forth in claim 1 wherein the means for accessing the look-up table is a microcomputer.

3. An apparatus as set forth in claim 2 and including means for updating said look-up table on a periodic basis.

4. An apparatus as set forth in claim 2 and including means for providing a calibration cycle to update the look-up table whenever the apparatus is turned on.

5. An apparatus as set forth in claim 2 and including environmental sensors for generating signals representing environmental conditions; and means responsive to said signals for providing a calibration cycle to update the look-up table.

6. An apparatus as set forth in claim 5 wherein the environmental sensor detects humidity and wherein said means for providing a calibration cycle provides said calibration cycle to update the look-up table when a sensor detects a change in relative humidity.

7. A method of controlling the voltage on a photoconductive surface of an image-forming member, comprising the steps of:

controlling the voltage on the photoconductive surface using a primary corona charger;

accessing a look-up table with a desired voltage for the photoconductive surface to determine the voltage to be applied to the primary corona charger;

adjusting the voltage to the primary corona charger to a new setting in accordance with the value obtained in the look-up table to obtain the desired voltage on the photoconductive surface; and providing a calibration cycle to update the look-up table when the measured voltage on the photoconductive surface differs by a predetermined amount from the predicted voltage supplied by the look-up table.

8. The method as set forth in claim 7 wherein the values in the look-up table are updated on a periodic basis.

9. The method as set forth in claim 8 wherein the updating of values in the look-up table is accomplished by stepping the voltage $V_{grid}$ on a corona charger grid through a series of values, and measuring the corresponding voltage $V_0$ on the photoconductive surface and storing the corresponding $V_{grid}/V_0$ pairs in the look-up table.

10. The method as set forth in claim 7 wherein a calibration cycle to update the look-up table is initiated when the machine is powered up.

11. The method as set forth in claim 7 wherein a calibration cycle to update the look-up table is initiated by environmental sensors.

12. The method as set forth in claim 11 wherein a calibration cycle to update the look-up table is initiated when a sensor detects a change in relative humidity.

13. The method of claim 7 and wherein adjusting of voltage to the primary charger is provided to a control grid that controls a flow of emissions from corona wires.

* * * * *